United States Patent [19]

Boie et al.

[11] 4,429,033

[45] Jan. 31, 1984

[54] PROCESS FOR THE PRODUCTION OF COLOR PRINTS BY THE DYE-DIFFUSION TRANSFER PROCESS

[75] Inventors: Immo Boie, Langenfeld; Manfred Peters, Leverkusen; Thomas Kaluschke, Leichlingen, all of Fed. Rep. of Germany

[73] Assignee: Agfa-Gevaert Aktiengesellschaft, Leverkusen, Fed. Rep. of Germany

[21] Appl. No.: 377,623

[22] Filed: May 13, 1982

[30] Foreign Application Priority Data

May 19, 1981 [DE] Fed. Rep. of Germany ..... 3119929

[51] Int. Cl.[3] ..... G03C 7/00; G03C 1/40; G03C 1/10; G03C 5/54

[52] U.S. Cl. ..... 430/237; 430/212; 430/214; 430/393

[58] Field of Search ..... 430/207, 212, 220, 223, 430/237, 214, 393, 390

[56] References Cited

U.S. PATENT DOCUMENTS 4,139,379 2/1979 Chasman et al. ..... 430/223

4,329,411 5/1982 Land ..... 430/220

*Primary Examiner*—Richard L. Schilling

*Attorney, Agent, or Firm*—Connolly and Hutz

[57] ABSTRACT

Color prints are prepared in the form of retained images by the dye diffusion transfer process using a photographic recording material comprising in that order a transparent layer support, a light-sensitive element containing at least one silver halide emulsion layer and a non-diffusing color-providing compound associated thereto, a light-reflecting opaque layer and a mordant layer. The recording material is subjected to imagewise exposure through the transparent layer support. During development a colored moiety is released from the color-providing compound in imagewise distribution and transferred to the mordant layer. Silver and silver halide is removed by bleaching and fixing. The colored color-providing compounds retained in the light-sensitive element in imagewise distribution complementary to the transferred colored moiety form the color image visible through the transparent layer support against the light-reflecting background of the opaque layer. The mordant layer prevents contamination of the developer by diffusible dyes.

5 Claims, No Drawings

PROCESS FOR THE PRODUCTION OF COLOR PRINTS BY THE DYE-DIFFUSION TRANSFER PROCESS

This invention relates to a process for the production of color prints by the dye-diffusion transfer process which enables the dye image retained in the photosensitive element during dye transfer ("retained image") to be used.

Integral color photographic recording materials for the dye-diffusion transfer process are known. Recording materials of this type are normally understood to be materials which, in a single layer assembly, contain all the means necessary for carrying out the process up to and including the production of a stable, storable color print, and in which there is no need for the individual layers to be separated from one another. More particularly, there is no need for separation between a dye-image-receiving layer (image-receiving layer) on the one hand and layers supplying a dye image (photosensitive element) on the other hand. Examples of integral color photographic recording materials of this type are described for example in U.S. Pat. Nos. 2,543,181 and 2,983,606, in DE-AS Nos. 1,924,430 and 2,052,145 and in DE-OS No. 22 28 665.

By virtue of the integral character of these recording materials, it is in general only the transfer image which is used. The originally photosensitive layers are concealed to the viewer, in general by an opaque layer formed by a developer liquid containing an opacifier. The transfer image is visible through a transparent layer support of the integral recording material against a reflecting background. In the terminology of the present patent application, a color image in a layer on a light reflecting opaque background will be called a "color print". Together with an image-receiving layer, a light-reflecting opaque layer and the various layers of the photosensitive element, which are applied to it in this order, the transparent support forms an inseparable layer assembly which forms an essential part, namely the photosensitive part, of the above-mentioned integral color photographic recording materials. Another transparent layer support is arranged on that side of the photosensitive element which is remote from the first transparent layer support and is not fixedly connected to it, but instead in such a way that a developer liquid can be distributed between this other transparent layer support and the photosensitive element.

It has also been proposed (cf. for example DE-OS Nos. 23 60 326 and 27 44 107) to use the dye image which after the diffusion transfer process remains behind in layers supplying dye image ("retained image") instead of or in addition to the dye image which is formed in the dye-image-receiving layer. A dye image such as this produced in layers supplying dye image has the advantage of greater definition over the dye image transferred by diffusion and produced in the dye-image-receiving layer, because the diffusion path has no effect upon the image contours. The diffusible dyes which are released imagewise during processing are removed from the layers supplying dye image either by being washed out or by being transferred to other layers of a multilayer recording material in which they form a colored transfer image which is complementary to the dye image retained in the layers supplying dye image ("retained image"). In order not to impair the optical impression of the retained dye image, the transferred dye image either has to be removed, for example by separating off the image-receiving layer, or has to be produced at least optically separated from the retained dye image produced in the layers supplying dye image, for example by arranging a reflecting, opaque layer permeable to alkaline processing solutions between the photosensitive layers supplying dye image on the one hand and the dye-image-receiving layer on the other hand. This opaque layer is capable on the one hand of masking the transferred dye image produced in the dye-image receiving layer and hence of concealing it from the viewer and, on the other hand, forms an optically attractive image background for the dye image retained in the layers supplying dye image. Accordingly, an opaque layer such as this arranged between layers supplying dye image and the dye-image-receiving layer may serve as an image background both for the retained dye image which is actually required and also for the less desirable transferred dye image. In this case, both dye images are not only complementary to one another, but also laterally inverted to one another because they only can be viewed from different sides.

The retained image produced in the layers supplying dye image is covered by a corresponding positive or negative silver image of the same contours. This silver image and also the unused silver halide have to be removed from the layers in order to improve the color impression and stability of the retained dye image produced in the photosensitive element. To achieve this, the color photographic recording material used is subjected in known manner, after development, to a bleaching and fixing treatment which may be carried out very easily by passing the recording material through corresponding baths. Another advantage of the process for producing retained dye images lies in the possibility of recovering most of the silver halide used. Integral color photographic recording materials are only suitable to a limited extent for this purpose, namely only insofar as the layer assembly comprising the essential layers is bounded on only one side by a layer support so that the necessary processing chemicals from aqueous baths have access from the other side.

If the recording material used consists solely of a photosensitive element (=layers supplying dye image) arranged on a reflecting support, the dyes released during development accumulate in the developer bath and render it prematurely unuseable. Where the recording material used consists of a layer support, a mordant layer, a reflecting opaque layer and a photosensitive element, of the type known for example as the photosensitive part of an integral color photographic recording material from DE-AS Nos. 1,924,430 and 2,052,145, some of the dye released is transferred to the mordant layer arranged below the photosensitive element and covered by the opaque layer. However, some of the development products again enter the developer liquid, so that the problem of premature contamination of the developer liquid also arises in this case.

An object of the present invention is to provide a process for the production of a retained dye image in which contamination of the developer liquid, above all by diffusible compounds released by the color-providing compounds, is avoided.

According to the invention, this object is achieved by a process for the production of a color print visible through a transparent layer support by the dye-diffusion transfer process in which a color photographic recording material comprising a transparent layer support, a photosensitive element comprising at least one photosensitive silver halide emulsion layer and a color-providing compound associated therewith, a light-reflecting opaque layer and a mordant layer, is exposed to form an image and developed.

The process according to the invention is characterized by the following features:

(1) The transparent layer support, the photosensitive element, the light-reflecting opaque layer and the mordant layer in that order form an inseparable layer assembly.

(2) The non-diffusing color-providing compound is
  (2.1) colored or at least capable of forming under the conditions of photographic development or any subsequent treatment a non-diffusing image dye and
  (2.2) capable of releasing in consequence of development and in imagewise distribution a diffusible anionic compound, thereby losing its color or its ability to form an image dye.

(3) The recording material is subjected to imagewise exposure through the transparent layer support.

(4) By treatment with an alkaline developer solution or paste, the following are formed adjacent one another in the photosensitive element:
  (4.1) a silver image,
  (4.2) an imagewise distribution of the non-diffusing color-providing compound or of an image dye formed therefrom under the development conditions and, complementarily thereto,
  (4.3) an imagewise distribution of the diffusible anionic compound released from the non-diffusing color-providing compound.

Under the conditions of photographic development, the latter (4.3) is transferred by diffusion to the mordant layer and fixed thereon.

(5) The silver image (4.1) and the undeveloped silver halide are removed by bleaching and fixing.

(6) The recording material is optionally subjected to another treatment to convert the non-diffusing color-providing compound present in imagewise distribution in the photosensitive element into an image dye.

Accordingly, essential layer elements of the recording material used in accordance with the invention are 1. a transparent layer support;
2. a photosensitive element;
3. a light-reflecting opaque layer;
4. a mordant layer;

which form an inseparable layer assembly in that order. This means that they are arranged one above the other in such a way that no layer separation can occur, even temporarily, at any stage during production, storage processing and subsequent keeping of the final image under the usual conditions. More particularly, no layer separation should occur between the transparent layer support and the photosensitive element. The layer elements mentioned above are cast over one another in the usual way in the sequence indicated and adhere to one another. In this connection, it is pointed out in particular that there is no need to provide any edge surround to keep the various layers together. It is also pointed out that development and processing chemicals are intended to have free access from the side remote from the transparent layer support, which means that no layer support which is impermeable to aqueous processing liquids should be present on that side, at least during processing.

The transparent support materials normally used in photography, for example films of cellulose esters, polyethylene terephthalate, polycarbonate or other film-forming polymers, may be used as the transparent layer support (layer element 1) for the color photographic recording material used in accordance with the invention.

The photosensitive element (layer element 2) is another essential part of the color photographic recording material used in accordance with the invention. For the production of one-color images, it contains a photosensitive silver halide emulsion layer and, associated therewith, a non-diffusing color-providing compound. The color-providing compound may be accommodated in a layer adjacent the silver halide emulsion layer or in the silver halide emulsion layer itself. For producing multicolor images in natural colors, however, the photosensitive element generally contains three such associations of color-providing compound and photo-sensitive silver halide emuslion layer, the absorption range of the image dye resulting from the color-providing compound generally coinciding to a large extent with the spectral sensitivity range of the associated silver halide emulsion layer. To obtain as high a sensitivity as possible, it can be advantageous for the color-providing compound to be arranged in a separate binder layer (looking in the direction of the incident light during exposure) behind the silver halide emulsion layer, or to have an absorption which is different from that of the image dye formed therefrom (for example "shifted dye"—U.S. Pat. No. 3,854,945). In general, alkali-permeable separating layers are present between the various associations of differently spectrally sensitized silver halide emulsion layers and color-providing compound, their function being to prevent any color adulteration. Separating layers of this type are particularly effective when they contain compounds which are capable of rendering diffusible developer oxidation products harmless.

In the context of the invention, "association" and "associated" are understood to mean that the mutual arrangement of the photosensitive silver halide emulsion layer and the non-diffusing color-providing compound is such that an interaction between them is possible during development, allowing the diffusible compound, for example a dye, to be released in dependence upon the development of the silver halide emulsion layer. The photosensitive silver halide and the color-providing compound do not necessarily have to be present in the same layer for this purpose. They may even be accommodated in adjacent layers each belonging to the same layer unit.

Another essential component of the color photographic recording material used in accordance with the invention is the light-reflecting opaque layer (layer element 3) which is arranged above the photosensitive element and which is permeable to aqueous alkaline solutions. The main function of this layer is to screen off from the viewing side the imagewise distribution transferred to the mordant layer of the diffusible anionic compound released from the color-providing compound and, optionally, other development products and to provide an aesthetically attractive image background for the retained dye image produced in the photosensitive element. This is achieved in known manner by a binder layer containing a light, more particularly white, pigment, for example $TiO_2$.

The mordant layer of the color photographic recording material used in accordance with the invention (layer element 4) consists essentially of a binder containing mordants for fixing the diffusible anionic compounds released from the non-diffusing color-providing compounds and, optionally, other development products. Preferred mordants for anionic compounds, for example acid dyes, are long-chain quaternary ammonium or phosphonium compounds or tertiary sulfonium compounds, for example those of the type described in U.S. Pat. Nos. 3,271,147 and 3,271,148. It is also possible to use certain metal salts and their hydroxides which form sparingly soluble compounds with the acid dyes. Reference is also made here to polymeric mordants, such as for example those of the type described in DE-OS Nos. 23 15 304 26 31 521 and 29 41 818. The dye mordants are dispersed in one of the usual hydrophilic binders, for example in gelatin, polyvinyl pyrrolidone, completely or partially hydrolysed cellulose esters, in the mordant layer. Some binders may, of course, also function as mordants, as is the case for example with copolymers or polymer mixtures of vinyl alcohol and N-vinyl pyrrolidone of the type described, for example, in DE-AS No. 1,130,284, and also polymers of nitrogen-containing quaternary bases, for example polymers of N-methyl-2-vinyl pyridine of the type described for example in U.S. Pat. No. 2,484,430. Other suitable mordant binders are, for example, guanyl hydrazone derivatives of alkyl vinyl ketone polymers, of the type described for example in U.S. Pat. No. 2,882,156, or guanyl hydrazone derivatives of acyl styrene polymers of the type described, for example in DE-OS No. 20 09 498. In general, however, other binders, for example gelatin, will be added to the last of the mentioned mordant binders.

In addition, special embodiments of the color photographic recording material used in accordance with the invention may contain further layers. Thus, a hardened protective layer may be arranged over the mordant layer in order to protect the layer assembly against mechanical damage. If desired, a protective layer such as this may also contain matting agents or opacifiers or agents for producing an opaque mask to cover a colored transfer image from the back as well, thereby concealing it from the viewer.

It is obvious that protective layers of the type in question must be permeable to aqueous alkaline processing solutions, at least during development. In addition, an additional light-absorbing opaque layer which may consist for example of a binder with a dark pigment, such as carbon black, dispersed therein, may be present between the mordant layer and the light-reflecting opaque layer. An additional light-absorbing opaque layer such as this may provide the photosensitive element with additional protection against light coming in from the back. In addition, it makes a dye image transferred to the mordant layer and optionally visible from the back appear uniformly darker and hence less conspicuous. Finally, additional layers may be present in known manner on the back of the transparent layer support of the recording material used in accordance with the invention, providing they are transparent enough to enable the photosensitive element to be exposed imagewise and the retained image produced to be viewed through the transparent support. An additional layer such as this may, for example, be used for improving the lay-flat properties of the color photographic recording material or may contain one or more correcting dyes capable of being decolored or washed out during processing for improving the color balance of the colour photographic recording material used in accordance with the invention.

Accordingly, the color photographic recording material used in accordance with the invention differs on first view from assemblies of the type known as parts of integral color photographic recording materials for the production of color transfer images, for example from DE-AS Nos. 1,924,430 and 2,052,145. In the known recording materials, the image-receiving layer, the light-reflecting opaque layer and the photosensitive element are firmly applied (in that order) to a transparent layer support, whereas in the material used in accordance with the invention the order in which the layer elements are firmly applied to the transparent layer support is reversed. Although, in the known recording material, the above-mentioned layer elements and the second transparent layer support present in that material follow the same order as in the recording material used in accordance with the invention, provision is made in the known recording material for an at least temporary separation between the photosensitive element and the (second) transparent layer support for the purpose of introducing and distributing the developer liquid containing an opacifier. An arrangement such as this cannot be used in the process according to the invention because the retained image required would be concealed to the viewer. Because it is so easy to make up, the color photographic recording material used in accordance with the invention may be supplied as required in the form of individual sheets or even in web form. The format of the color photographic recording material is also not subject to any limitations. If desired, it may even be cut to the required size by the user before processing, thereby enabling margin-free photographs to be produced in any format without any need for subsequent cutting.

Other requirements which have to be satisfied by the non-diffusing color-providing compounds used arise out of the fact that it is the dye image retained in the photosensitive element rather than the transferred dye image which is used in the process according to the invention. In the context of the invention, color-providing compounds are compounds which 1. are colored or are at least capable of forming under the conditions of photographic development or any subsequent treatment non-diffusing image dyes, and which
2. are capable of releasing in consequence of photographic development in imagewise distribution diffusible anionic compounds, thereby losing their color or their ability to form image dyes.

Whereas in known processes for the production of colored transfer images the diffusible compounds released imagewise from the color-providing compounds either had themselves to be dyes or had to be capable of conversion into dyes, this is not among the requirements of the process according to the invention. Rather, it is important that the color-providing compound as a whole should supply the image dye or should be capable of conversion into an image dye, but should no longer be able to satisfy either of these requirements after a certain part of the molecule, which may be colored but of which the color-forming properties are of no significance whatever to the invention, has been split off imagewise. In general, however, the same non-diffusing color-providing compounds known from processes for producing colored transfer images may also be used in the process according to the invention.

Another difference from known layer assemblies lies in the fact that the photosensitive silver halide emulsions and the associated non-diffusing color-providing compounds are selected in such a way that it is not the transferred dye image, but rather the complementary retained dye image, which forms a positive copy of the original to be reproduced. This means that, according to the invention, those classes of color-providing compounds which required the use of direct-positive silver halide emulsions for producing positive transfer images, may be used with standard negative silver halide emulsions. Non-diffusing color-providing compounds of this type have been frequently described, for example in U.S. Pat. Nos. 3,227,550; 3,443,939 and 3,443,940 and DE-OS Nos. 19 30 215, 22 42 762, 24 06 664, 25 05 248, 26 13 005 and 26 45 656.

In the process according to the invention, these compounds, in combination with negative silver halide emulsions, give a positive retained dye image when the original to be reproduced is itself used as the subject to be photographed. Where a negative is used as the original, these compounds have to be combined with direct positive emulsions in the process according to the invention to give a positive retained image of the original.

According to the invention, it is also possible to use non-diffusing color-providing compounds of the type which essentially only in the non-oxidized form are capable of releasing diffusible compounds, for example dyes, but are prevented from doing so in oxidized form. Color-providing compounds of this type are described, for example, in DE-OS Nos. 24 02 900, 25 43 902, 28 09 716, 28 23 159 and 28 54 946, in BE-PS No. 861,241, in EP-A No. 0 004 399 and in British Patent Application No. 80 12 242. Where the color-providing compounds just mentioned are present in oxidized form, they are generally used in combination with so-called electron donor compounds (ED-compounds) or electron donor precursor compounds (ED-precursor compounds) of the type described, for example, in DE-OS Nos. 28 09 716, 29 47 425 and 30 06 268.

Depending on whether the original itself or a negative prepared therefrom is used for exposure in the process according to the invention, the color-providing compounds just mentioned have to be used in combination either with direct-positive silver halide emulsions or with negative silver halide emulsions in order to provide a positive copy of the original as the retained image.

Of the non-diffusing color-providing compounds mentioned above, those which already have the required image color and which release the chromophoric group responsible for the color imagewise as a diffusible dye in consequence of development are particularly suitable for use in the process according to the invention. Other suitable color-providing compounds are those which, although colorless or having a color different from that of the required image dye, are capable of being converted into the required image dyes under the conditions of photographic development or of any suitable subsequent treatment, whether by oxidation, by coupling, by complexing or by the exposure of an auxochromic group in a chromophoric system, for example by hydrolytic cleavage, but which are no longer capable of being converted into the required image dyes if, in consistency with the silver image produced or in complementary distribution thereto, the above-mentioned diffusible compounds, for example chromophoric groups, have been split off from the non-diffusing color-providing compounds.

The color photographic recording material used in accordance with the invention is equally suitable for use as a recording material and as a copying material. In either case, exposure is effected through the transparent layer support. Where the color photographic recording material is used as a recording material, it is possible in principle to use any photographic camera. There is no need for any of the expensive special devices encountered in conventional instant-picture cameras. For producing colored copies, the color photographic recording material used in accordance with the invention is generally exposed imagewise in a darkroom, for example in contact with a transparent colored original or using a standard projectiontype enlarger.

The processing of the recording material exposed imagewise through the transparent layer support generally comprises the steps of development, bleaching and fixing, of which the last two may even be combined into a single bleach-fixing treatment.

Development may be carried out in an aqueous processing bath which contains the alkali required for development and, optionally, the necessary developer substances. However, the necessary developer substances may also be completely or partly contained in known manner in layers of the color photographic recording material. However, development may also be carried out by applying a layer of a viscous developer paste, for example by distributing a paste of this type between the color photographic recording material according to the invention and an auxiliary developer sheet placed over it. After development, the auxiliary developer sheet is peeled off and any residues of developer which may still be adhering to the uppermost layer of the color photographic recording material according to the invention may be removed by washing.

During development, a positive or negative silver image (4.1.) is formed in the photosensitive element, depending on the type of silver halide emulsion used. At the same time and in consequence of development of the silver halide, an imagewise distribution of diffusible anionic compounds, for example diffusible dyes, is released from the non-diffusing color-providing compound initially present in uniform distribution, which in the most simple cases is colored and already has the color of the required image dyes, in imagewise consistency with the silver image produced or in complementary distribution thereto (4.3.), passes by diffusion into the mordant layer and is fixed thereon. The imagewise distribution of unchanged color-providing compound retained in complementary distribution thereto in the photosensitive element (4.2.) then represents the required dye image. However, the color-providing compounds may not initially have the required color, but only assume the required color through modification of the chromophoric group in a subsequent treatment (for example by hydrolysis, oxidation or complexing).

Silver and silver halide, which are present in the photosensitive element in addition to the dye image retained therein, are then removed, usually in a processing step following the development. This is done in the usual way either by treatment with suitable liquid bleaching, fixing or bleach-fixing baths, which may be carried out in suitable processing tanks, or also using viscous processing pastes. For example, it is even possible for this purpose to use an auxiliary sheet which contains the necessary bleaching and fixing agents in a binder layer and which is temporarily laminated onto the developed color photograpic recording material according to the invention. Bleach-fixing sheets suitable for this purpose are described for example in Research Disclosure No. 18 157 (May 1979).

This may optionally be followed by another treatment for converting the color-providing compounds retained in imagewise distribution in the originally photosensitive element into the final image dyes required or even for improving fastness to light. Where the color-providing compounds in question are compounds which are capable of forming colored complexes with certain heavy metal ions, for example Cu- or Ni-ions, a further treatment of the type in question may for example comprise bathing the recording material in an aqueous solution of a suitable heavy metal salt.

It has proved to be advantageous in the process according to the invention for the photosensitive element to be covered by an outer layer in the form of a mordant layer in which the diffusible anionic compound, particularly diffusible dyes, released from the color-providing compound in imagewise distribution during development are intercepted and fixed. In this way, premature contamination of the development bath with development products, particularly dyes, is largely avoided. Another advantage lies in the fact that the retained image produced in the photosensitive element is optimally protected against mechanical damage by the transparent support.

Where the anionic compounds released from the non-diffusible dye-producing compounds and transferred to the mordant layer color the mordant layer (transfer image) to the detriment of the overall impression of the dye image produced, it is possible as already mentioned to lessen this influence, for example by arranging a light-absorbing opaque layer between the light-reflecting opaque layer and the mordant layer so that the transfer image visible from the back (i.e. from the side remote from the transparent layer support) appears less rich in contrast and hence less noticeable, or by using as the outermost layer another light-reflecting opaque layer which completely covers the transfer image and, in doing so, provides an image sheet produced in accordance with the invention with an attrative appearance, even from the back. Another possibility is permanently to laminate the color photographic material processed in accordance with the invention, on that side remote from the transparent support, onto an opaque layer support, preferably onto a paper support.

EXAMPLE 1

A photosensitive element of a photographic recording material according to the invention was prepared by succesively applying the following layers to a transparent support of polyethylene terephthalate (the quantities quoted are based in each case on one square meter):

1. A blue-sensitized emulsion layer of an iodide-containing silver bromide emulsion (silver coating 0.30 g), 0.55 g of gelatin and 0.45 g of compound A which releases a yellow dye.
2. An intermediate layer of 1 g of gelatin.
3. A hardening layer of 0.06 g of hardener E and 0.6 g of gelatin.
4. A white pigment layer of 18.3 g of $TiO_2$ and 2.6 g of gelatin.
5. A mordant layer of 2.7 g of compound D and 2.7 g of gelatin.
6. A hardening layer of 0.9 g of hardener E.

A strip of the recording material was exposed through a wedge original and then immersed for 5 minutes in a liquid developer having the following composition. The developed strip was then bleach-fixed, rinsed and dried. The result was a yellow positive copy of the original: Dmin 0.33, Dmax 1.49.

| | |
|---|---|
| Developer bath | 15 g of KOH |
| | 3 g of KBr |
| | 1 g of 4-methyl-4-hydroxy-methyl phenidone |
| | 10 ml of benzylalcohol |
| | 1 g of paraformaldehyde |
| | 970 g of $H_2O$ |
| Bleach-fixing bath | 45 g of Fe-III—Na—EDTA |
| | 15 g of $Na_4$—EDTA |
| | 0.1 g of mercaptotriazole |
| | 10.5 g of $Na_2CO_3$ sicc. |
| | 120 g of ammonium thiosulfate |
| | 8 g of $Na_2SO_3$ sicc. |
| | made up with water to 1 liter |

EXAMPLE 2

In otherwise the same layer arrangement as in Example 1, layer 1 was replaced by a green-sensitized emulsion layer of an iodide-containing silver bromide emulsion (silver coating 0.30 g), 0.56 g of gelatin and 0.29 g of compound B which releases a magenta dye.

Processing in the same way as in Example 1 resulted in the formation of a positive, magenta-colored copy of the original: Dmin 0.37, Dmax 1.47.

EXAMPLE 3

In otherwise the same layer arrangement as in Example 1, layer 1 was replaced by a red-sensitized emulsion layer of an iodide-containing silver bromide emulsion (silver coating 0.30 g) 0.56 g of gelatin and 0.29 g of compound C which releases a cyan dye.

Processing in the same way as in Example 1 produced a positive, cyan-colored copy of the original: Dmin 0.14, Dmax 2.01.

EXAMPLE 4

The following layers were applied as in Example 1 to a transparent polyethylene terephthalate substrate:

1. A blue-sensitized emulsion layer corresponding to layer 1 in Example 1.
2. A barrier layer for oxidized auxiliary developer of 0.4 g of 2-acetyl-5-octadecylhydroquinone and 1 g of gelatin.
3. A green-sensitized emulsion layer corresponding to layer 1 in Example 2.
4. A barrier layer for oxidized auxiliary developer corresponding to layer 2 above.
5. A red-sensitized emulsion layer corresponding to layer 1 in Example 3.
6. A hardening layer of 0.12 g of hardener E and 0.6 g of gelatin.
7. A white pigment layer corresponding to layer 4 in Example 1.
8. A mordant layer corresponding to layer 5 in Example 1.
9. A hardening layer corresponding to layer 6 in Example 1.

A strip of recording material was exposed through the transparent layer support, subsequently developed for 10 minutes, bleach-fixed and rinsed (for the composition of the developer bath and bleach-fixing bath, see Example 1). A positive copy of the original having the following sensitometric data was obtained:

| | Color of filter | | |
|---|---|---|---|
| | blue | green | red |
| $D_{min}$ | 1.24 | 0.66 | 0.52 |
| $D_{max}$ | 1.84 | 1.92 | 2.02 |

In addition, strips of the material measuring 11.4 cm×7.5 cm were exposed and then developed on the one hand for 10 minutes and on the other hand for 1 hour, in each case in 250 ml of developer. The two developer samples were then photometrically evaluated against an unused developer sample. Even after a development time of 1 hour, it was not possible to detect any increase in density over the entire measuring range of from 400 to 700 nm. This showed that the dyes released has been effectively intercepted by the overlying mordant layer.

Accordingly, photographic reproductions may readily be produced in the form of "retained images" using the layer arrangement described in the foregoing. By virtue of the fact that the photosensitive element is enclosed on one side by the polyethylene terephthalate support and on the other side by the combination of the light-reflecting opaque layer and the mordant layer, development may be carried out in any baths without the developer being contaminated by released dyes. The dyes released imagewise are quantitatively intercepted by the "overcoating" with mordant.

Compound A

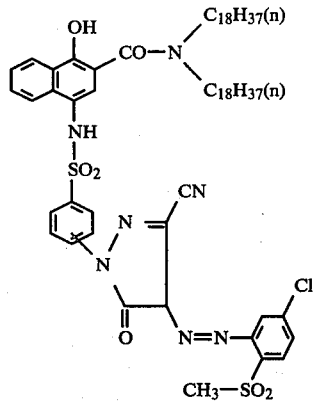

Compound B

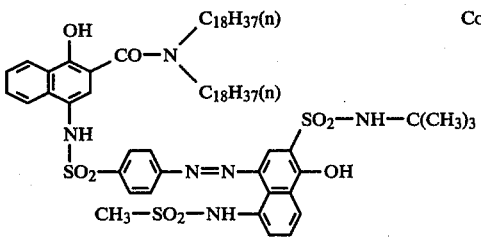

-continued

Compound C

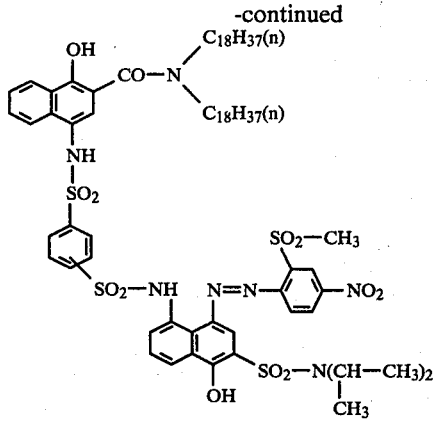

Compound D

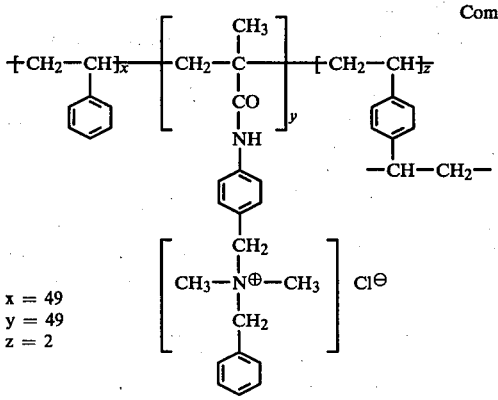

x = 49
y = 49
z = 2

Compound E

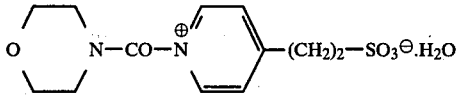

We claim:

1. A process for the production in the dye diffusion process of a color print visible through a transparent layer support, in which a color photographic recording material comprising a transparent layer support, a photosensitive element comprising at least one photosensitive silver halide emulsion layer and a non-diffusing color-providing compound associated therewith, a light-reflecting opaque layer and a mordant layer, is exposed imagewise and developed wherein the improvement comprises a novel combination of improvements of said dye diffusion process of (1) the transparent layer support, the photosensitive element, the light-reflecting opaque layer and the mordant layer being formed in that order in an inseparable layer assembly;

(2) the non-diffusing color-providing compound being first, capable of forming under the conditions of photographic development or any subsequent treatment a non-diffusing image dye and second, capable of releasing in consequence of development and in imagewise distribution a diffusible anionic compound, thereby losing its ability to form an image dye;

(3) the recording material being subjected to imagewise exposure through said transparent layer support;

(4) the exposed recording material being treated with an alkaline developer solution or paste to form each of the following in the photosensitive element:

a silver image;

a positive retained image consisting of an imagewise distribution of the non-diffusing color-providing compound or of an image dye formed therefrom under the development conditions and, complementarily thereto an imagewise distribution of the diffusible anionic compound released from the non-diffusing color-providing compound, the latter being transferred by diffusion, under the conditions of photographic development, to the mordant layer and fixed thereon;

(5) said silver image and the undeveloped silver halide are removed by bleaching and fixing; and (6) when said positive retained image forming non-diffusing color-providing compound after development, bleaching and fixing does not have the color of the required positive dye image the recording material is additionally subjected to another treatment to convert the non-diffusing color-providing compound present in imagewise distribution in the photosensitive element into an image dye.

2. A process as claimed in claim 1 wherein the recording material used comprises another light-reflecting opaque layer over the mordant layer.

3. A process for the production in the dye diffusion process of a color print visible through a transparent layer support, in which a color photographic recording material comprising a transparent layer support, a photosensitive element comprising at least one photosensitive silver halide emulsion layer and a color-providing compound associated therewith, a light-reflecting opaque layer and a mordant layer is exposed imagewise and developed, wherein the improvement comprises a novel combination of improvements of said dye diffusion process of (1) the transparent layer support, the photosensitive element, the light-reflecting opaque layer and the mordant layer being formed in that order in an inseparable layer assembly;

(2) the non-diffusing color-providing compound being first, colored and second, capable of releasing in consequence of development and in imagewise distribution a diffusible anionic dye, thereby losing its color;

(3) the recording material being subjected to imagewise exposure through said transparent layer support;

(4) the exposed recording material being treated with an alkaline developer solution or paste to form each of the following in the photosensitive element:

a silver image, a positive retained image consisting of an imagewise distribution of a colored non-diffusing color-providing compound or of an image dye formed therefrom under the development conditions and, complementary thereto an imagewise distribution of the diffusible anionic dye released from the colored non-diffusing color-providing compound, the latter being transferred by diffusion, under the conditions of photographic development, to the mordant layer and fixed thereon;

(5) said silver image and the undeveloped silver halide are removed by bleaching and fixing;

and (6) when said colored non-diffusing color-providing compound after development, bleaching and fixing has a color other than the color of the required positive dye image the recording material is additionally subjected to another treatment to convert the colored non-diffusing color-providing compound present in the imagewise distribution in the photosensitive element into an image dye.

4. A process as claimed in claim 3 wherein the recording material used comprises another light-reflecting opaque layer over the mordant layer.

5. A process as claimed in claim 3 wherein the non-diffusing color-providing compound has the color of the required dye image (component image) and, in consequence of development, releases a diffusible dye imagewise and is thus decolored.

* * * * *